US007225873B2

(12) United States Patent
Schlegelmilch et al.

(10) Patent No.: US 7,225,873 B2
(45) Date of Patent: Jun. 5, 2007

(54) COILED TUBING CUTTER

(75) Inventors: Tye Schlegelmilch, New York, NY (US); Gary Rytlewski, League City, TX (US); Vance Nixon, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/425,670

(22) Filed: Jun. 21, 2006

(65) Prior Publication Data

US 2006/0254773 A1 Nov. 16, 2006

Related U.S. Application Data

(63) Continuation of application No. 10/321,217, filed on Dec. 17, 2002, now Pat. No. 7,086,467.

(51) Int. Cl.
*E21B 29/00* (2006.01)
*E21B 33/035* (2006.01)
*E21B 33/064* (2006.01)

(52) U.S. Cl. ..... 166/298; 166/361; 166/368; 166/86.3

(58) Field of Classification Search ..... 166/335, 166/340, 361, 359, 360, 363, 364, 367, 368, 166/297, 298, 55, 377, 75.11, 55.2, 55.3, 166/55.6, 54.5, 54.6
See application file for complete search history.

(56) References Cited

U.S. PATENT DOCUMENTS 3,399,728 A * 9/1968 Taylor ..... 166/53
3,561,526 A * 2/1971 Williams et al. ..... 166/55
3,590,920 A * 7/1971 Orund et al. ..... 166/55
3,692,107 A * 9/1972 Slator et al. ..... 166/55
3,736,982 A * 6/1973 Vujasinovic ..... 166/55
3,766,979 A * 10/1973 Petrick ..... 166/55
3,782,459 A * 1/1974 Murray ..... 166/355
3,817,326 A * 6/1974 Meynier, III ..... 166/55
3,848,667 A * 11/1974 Clark, Jr. ..... 166/55.6
3,870,098 A * 3/1975 Houston ..... 166/55.1
3,870,101 A * 3/1975 Helmus ..... 166/363
3,946,806 A * 3/1976 Meynier, III ..... 166/55

(Continued)

FOREIGN PATENT DOCUMENTS

WO WO9213170 A * 8/1992

OTHER PUBLICATIONS

Bourgoyne, Jr. et al., Applied Drilling Engineering, 1991, Society of Petroleum Engineers, vol. 2, p. 23.*
"Shear", Merriam-Webster's Collegiate Dictionary, 1990, Merriam-Webster, Inc., 10th Edition, p. 1078.*

*Primary Examiner*—Jennifer H Gay
(74) *Attorney, Agent, or Firm*—Fred G. Pruner; Bryan P. Galloway; Tim Curington

(57) ABSTRACT

A cutting module to sever a tubing in a well includes a piston and shear blade. The piston includes at least two moveable telescoping elements, which are adapted to expand the first piston from a retracted length to an expanded length. The shear blade is connected to the piston to sever the tubing in response to the piston expanding from the retracted length to the expanded length. The cutting module may be located below a safety valve in the well.

19 Claims, 6 Drawing Sheets

U.S. PATENT DOCUMENTS 4,043,389 A * 8/1977 Cobb ..... 166/55
4,132,265 A * 1/1979 Williams, Jr. ..... 166/55
4,132,266 A * 1/1979 Randall ..... 166/55
4,132,267 A * 1/1979 Jones ..... 166/55
4,160,478 A * 7/1979 Calhoun et al. ..... 166/55.1
4,163,477 A * 8/1979 Johnson et al. ..... 166/363
4,215,749 A * 8/1980 Dare et al. ..... 166/361
4,240,503 A * 12/1980 Holt et al. ..... 166/55
4,290,577 A * 9/1981 Olson ..... 251/1.3
4,305,565 A * 12/1981 Abbe ..... 251/1.3
4,313,496 A * 2/1982 Childs et al. ..... 166/55
4,341,264 A * 7/1982 Cox et al. ..... 166/55
4,347,898 A * 9/1982 Jones ..... 166/55
4,436,157 A * 3/1984 Brooks ..... 166/344
4,523,639 A * 6/1985 Howard, Jr. ..... 166/55
4,531,585 A * 7/1985 Hansen ..... 166/297
4,537,250 A * 8/1985 Troxell, Jr. ..... 166/55
4,540,046 A * 9/1985 Granger et al. ..... 166/55
4,580,626 A * 4/1986 Jones ..... 166/55
4,646,825 A * 3/1987 Van Winkle ..... 166/55
4,685,521 A * 8/1987 Raulins ..... 166/341
4,923,005 A * 5/1990 Laky et al. ..... 166/55
5,002,130 A * 3/1991 Laky ..... 166/351
5,199,683 A * 4/1993 Le ..... 251/1.3
5,360,061 A * 11/1994 Womble ..... 166/55
5,735,502 A * 4/1998 Levett et al. ..... 251/1.3
6,053,252 A * 4/2000 Edwards ..... 166/348
6,125,928 A * 10/2000 Ninivaara et al. ..... 166/55
6,158,505 A * 12/2000 Araujo ..... 166/55
6,173,770 B1 * 1/2001 Morrill ..... 166/85.4
6,244,336 B1 * 6/2001 Kachich ..... 166/55
6,293,344 B1 * 9/2001 Nixon et al. ..... 166/363
6,719,042 B2 * 4/2004 Johnson et al. ..... 166/55
2001/0035287 A1 * 11/2001 Collie ..... 166/54.5
2001/0050172 A1 * 12/2001 Tolman et al. ..... 166/297
2004/0003919 A1 * 1/2004 Johnson et al. ..... 166/55

* cited by examiner

COILED TUBING CUTTER

This application is a continuation of U.S. patent application Ser. No. 10/321,217, now U.S. Pat. No. 7,086,467 entitled "COILED TUBING CUTTER," which was filed on Dec. 17, 2002 , and is hereby incorporated by reference in its entirety.

BACKGROUND

The present invention relates generally to safety shut-in systems employed during testing or other operations in subsea wells. More specifically, the invention relates to a coiled tubing cutter for use with a safety shut-in system in a subsea well.

Offshore systems which are employed in relatively deep water for well operations generally include a riser which connects a surface vessel's equipment to a blowout preventer stack on a subsea wellhead. The marine riser provides a conduit through which tools and fluid can be communicated between the surface vessel and the subsea well.

Offshore systems which are employed for well testing operations also typically include a safety shut-in system which automatically prevents fluid communication between the well and the surface vessel in the event of an emergency, such as loss of vessel positioning capability. Typically, the safety shut-in system includes a subsea test tree which is landed inside the blowout preventer stack on a pipe string.

The subsea test tree generally includes a valve portion which has one or more normally closed valves that can automatically shut-in the well. The subsea test tree also includes a latch portion which enables the portion of the pipe string above the subsea test tree to be disconnected from the subsea test tree.

If an emergency condition arises during the deployment of tools on coiled tubing, for example, the safety shut-in system is first used to sever the coiled tubing. In a typical safety shut-in system, a ball valve performs both the function of severing the coiled tubing and the function of shutting off flow.

Although somewhat effective, the use of ball valves to sever the coiled tubing has proven difficult with larger sizes of coiled tubing. Additionally, use of the ball valves to perform cutting operations can have detrimental sealing effects on the sealing surfaces of the valve. Specifically, the sealing surfaces can become scarred, reducing the sealing efficiency.

There exists, therefore, a need for an efficient coiled tubing cutter.

DETAILED DESCRIPTION

It should be clear that the present invention is not limited to use with the particular embodiments of the subsea systems shown, but is equally used to advantage on any other well system in which severing of coiled tubing, wireline, slickline, or other production or communication lines may become necessary.

Furthermore, although the invention is primarily described with reference to intervention tools deployed on coiled tubing, it should be understood that the present invention can be used to advantage to sever wireline, slickline, or other production or communication line as necessary.

Figure 1:
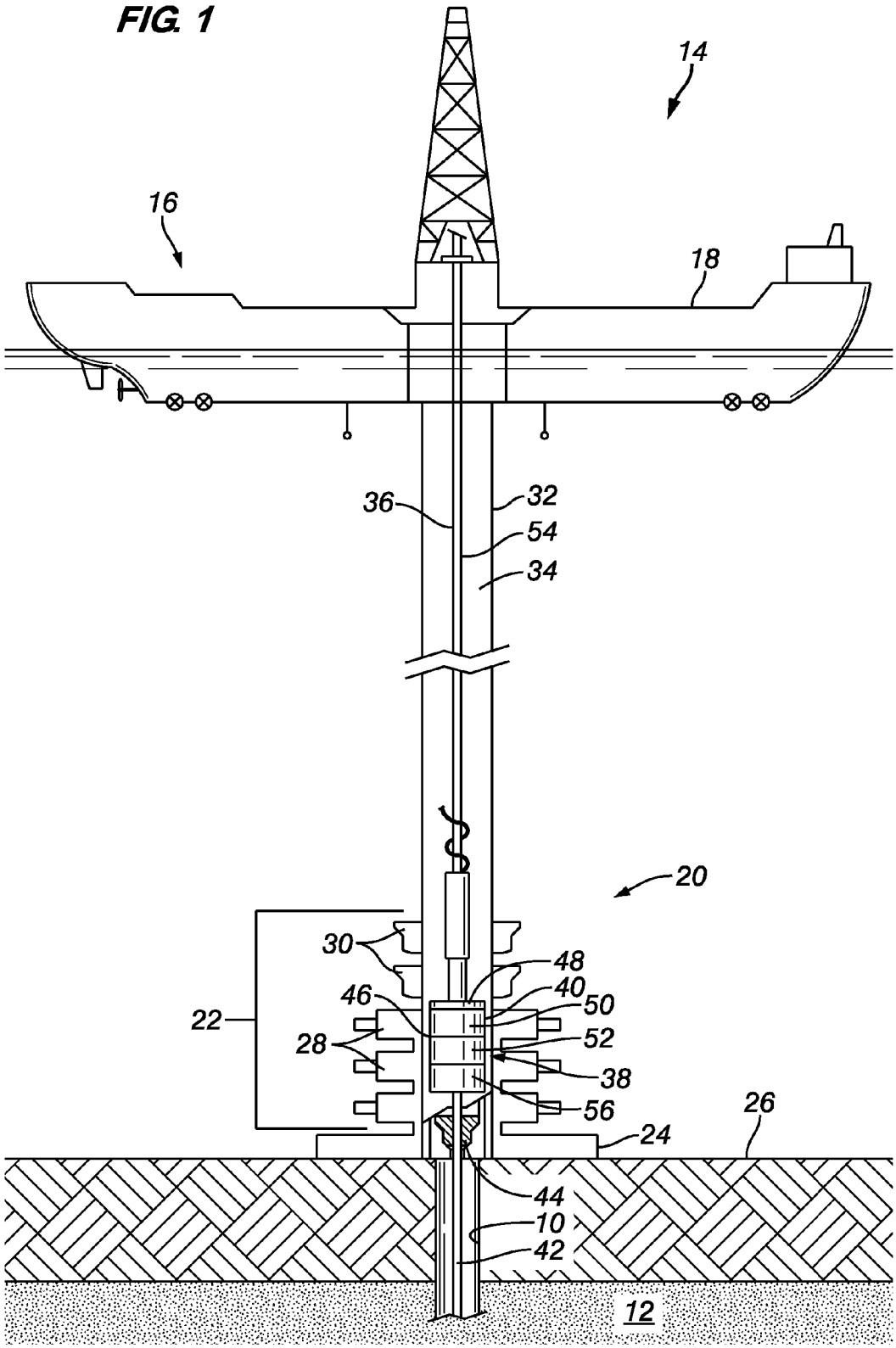
FIG. 1 illustrates an offshore system with a subsea tree having an embodiment of the cutting module of the present invention.

Referring to the drawings wherein like characters are used for like parts throughout the several views, FIG. 1 depicts a well 10 which traverses a fluid reservoir 12 and an offshore system 14 suitable for testing productivity of the well 10. The offshore system 14 comprises a surface system 16, which includes a production vessel 18, and a subsea system 20, which includes a blowout preventer stack 22 and a subsea wellhead 24.

The subsea wellhead 24 is fixed to the seafloor 26, and the blowout preventer stack 22 is mounted on the subsea wellhead 24. The blowout preventer stack 22 includes ram preventers 28 and annular preventers 30 which may be operated to seal and contain pressure in the well 10. A marine riser 32 connects the blowout preventer stack 22 to the vessel 18 and provides a passage 34 through which tools and fluid can be communicated between the vessel 18 and the well 10. In the embodiment shown, the tubing string 36 is located within the marine riser 32 to facilitate the flow of formation fluids from the fluid reservoir 12 to the vessel 18.

The subsea system 20 includes a safety shut-in system 38 which provides automatic shut-in of the well 10 when conditions on the vessel 18 or in the well 10 deviate from preset limits. The safty shut-in system 38 includes a subsea tree 40 that is landed in the blowout preventer stack 22 on the tubing string 36. A lower portion 42 of the tubing string 36 is supported by a fluted hanger 44.

The subsea tree 40 has a valve assembly 46 and a latch 48. The valve assembly 46 acts as a master control valve during testing of the well 10. The valve assembly 46 includes a normally-closed flapper valve 50 and a normally-closed ball valve 52. The flapper valve 50 and the ball valve 52 may be operated in series. The latch 48 allows an upper portion 54 of the tubing string 36 to be disconnected from the subsea tree 40 if desired.

In an embodiment of the present invention, the subsea tree 40 further comprises a cutting module 56 having opposing shear blades 58. The cutting module 56 is located below the valve assembly 46. If an emergency condition arises during deployment of intervention tools lowered through the tubing string 36 on coiled tubing, the blades 58 of the cutting module 56 are activated to sever the coiled tubing prior to the well being shut-in.

Figure 2:
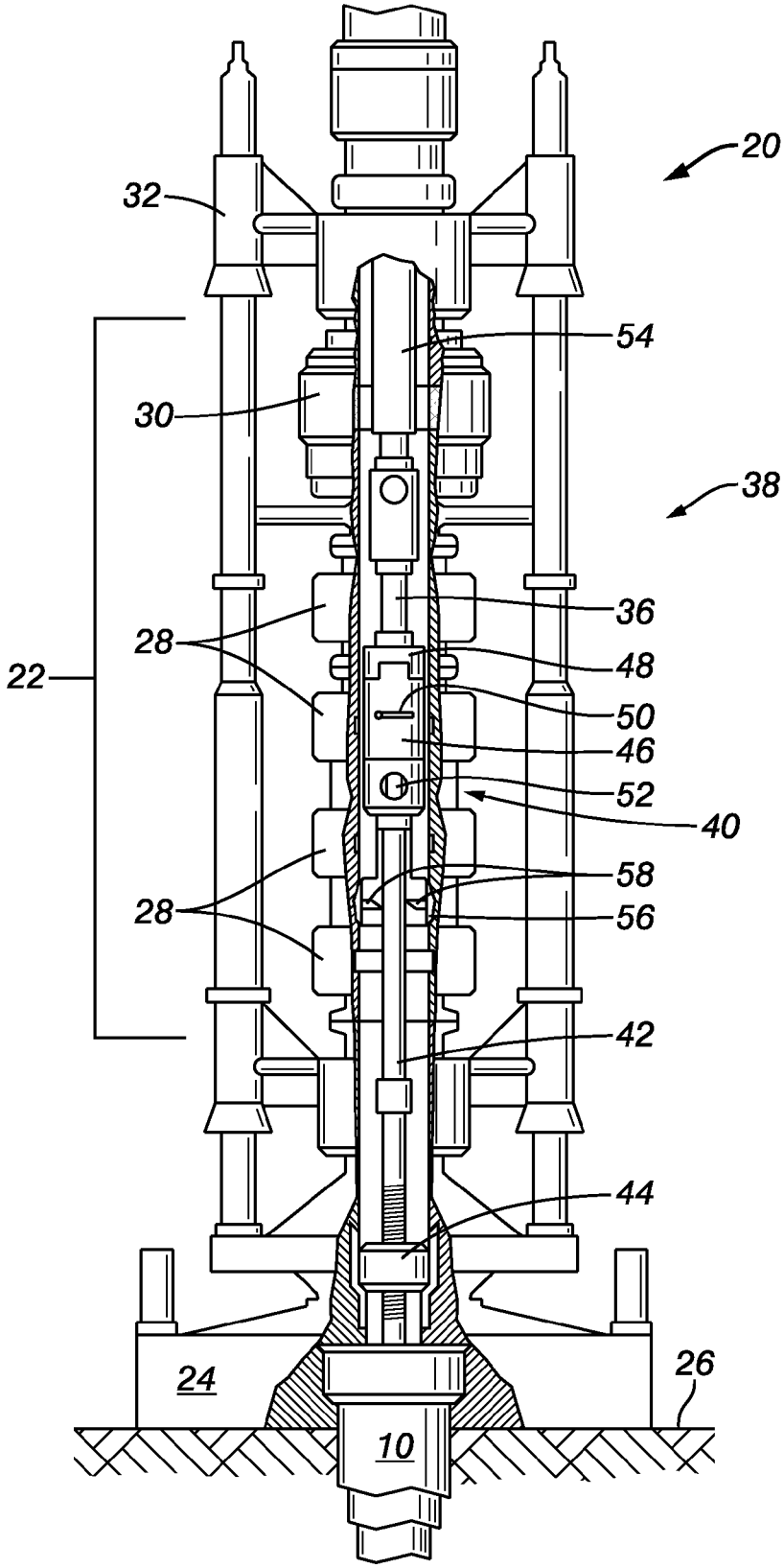
FIG. 2 illustrates a subsea system with a subsea tree having an embodiment of the cutting module of the present invention.

FIG. 2 illustrates a subsea system 20 having an embodiment of the cutting module 56 of the present invention. The subsea system 20 is adapted to facilitate production from a well 10 to an offshore vessel (not shown). The subsea system includes a blowout preventer stack 22, a subsea wellhead 24, and a safety shut-in system 38. The subsea wellhead 24 is fixed to the seafloor 26, and the blowout preventer stack 22 is mounted on the subsea wellhead 24. The blowout preventer stack 22 includes ram preventers 28 and annular preventers 30 which may be operated to seal and contain pressure in the well 10. A marine riser 32 connects the blowout preventer stack 22 to an offshore vessel and provides a passage through which tools and fluid can be communicated between the vessel and the well 10. In the embodiment shown, the tubing string 36 is located within the marine riser 32 to facilitate the flow of formation fluids from the fluid reservoir to the vessel.

The safety shut-in system 38 of the subsea system 20 provides automatic shut-in of the well 10 when conditions on the vessel deviate from preset limits. The safety shut-in system 38 includes a subsea tree 40 that is landed in the blowout preventer stack 22 on the tubing string 36. A lower portion 42 of the tubing string 36 is supported by a fluted hanger 44. The subsea tree 40 has a valve assembly 46 and a latch 48. The valve assembly 46 acts as a master control valve during testing of the well 10. The valve assembly 46 includes a normally-closed flapper valve 50 and a normally-closed ball valve 52. The flapper valve 50 and the ball valve 52 may be operated in series. The latch 48 allows an upper portion 54 of the tubing string 36 to be disconnected from the subsea tree 40 if desired.

Housed within the subsea tree 40 is an embodiment of the cutting module 56 of the present invention. The cutting module 56 is located below the valve assembly 46 and is shown in FIG. 2 with its blades 58 in their open position. If an emergency condition arises during deployment of intervention tools lowered through the tubing string 36 on coiled tubing, the blades 58 of the cutting module 56 are activated to sever the coiled tubing prior to the well being shut-in.

Figure 3:
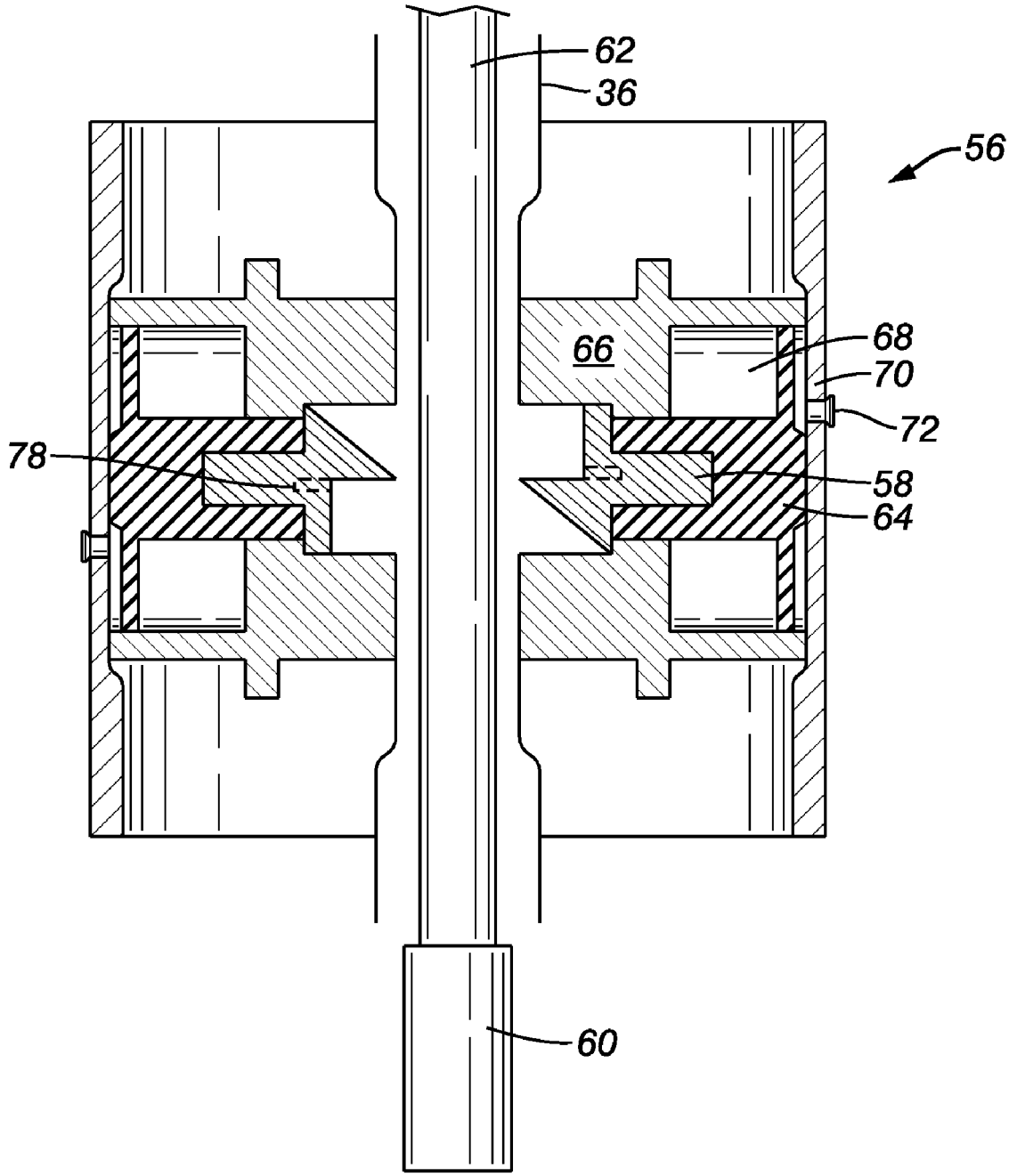
FIG. 3 shows an embodiment of the cutting module of the present invention with its blades in their open position.

FIG. 3 shows an embodiment of the cutting module 56 of the present invention with its blades 58 in their open position. An intervention tool 60 is lowered through the cutting module 56 on coiled tubing 62.

The blades 58 are shown in their open position and are affixed to a piston 64 located within a piston housing 66. A pressure chamber 68 is defined by the piston housing 66 and the outer wall 70 of the cutting module 56. One or more pressure ports 72 are located in the outer wall 70 of the cutting module 56 and enable communication of fluid (e.g., gas, hydraulic, etc.) pressure via control lines (not shown) into the pressure chamber 68.

To activate the blades 58, fluid pressure is supplied by the control lines to the one or more pressure ports 72. The fluid pressure acts to push the pistons 64 toward the coiled tubing 62 until the blades 58 overlap and shear the coiled tubing 62 running within. After the coiled tubing 62 has been cut by the blades 58, the fluid pressure supplied by the control lines is discontinued and the pressurized pistons 64 and blades 58 return to their open state as a result of the much higher bore pressure existing within the tubing string 36.

In some embodiments, to accommodate the overlap of the blades 58, hollow slots 78 (shown in hidden lines) are provided in the face of the opposing blades 58.

Figure 4:
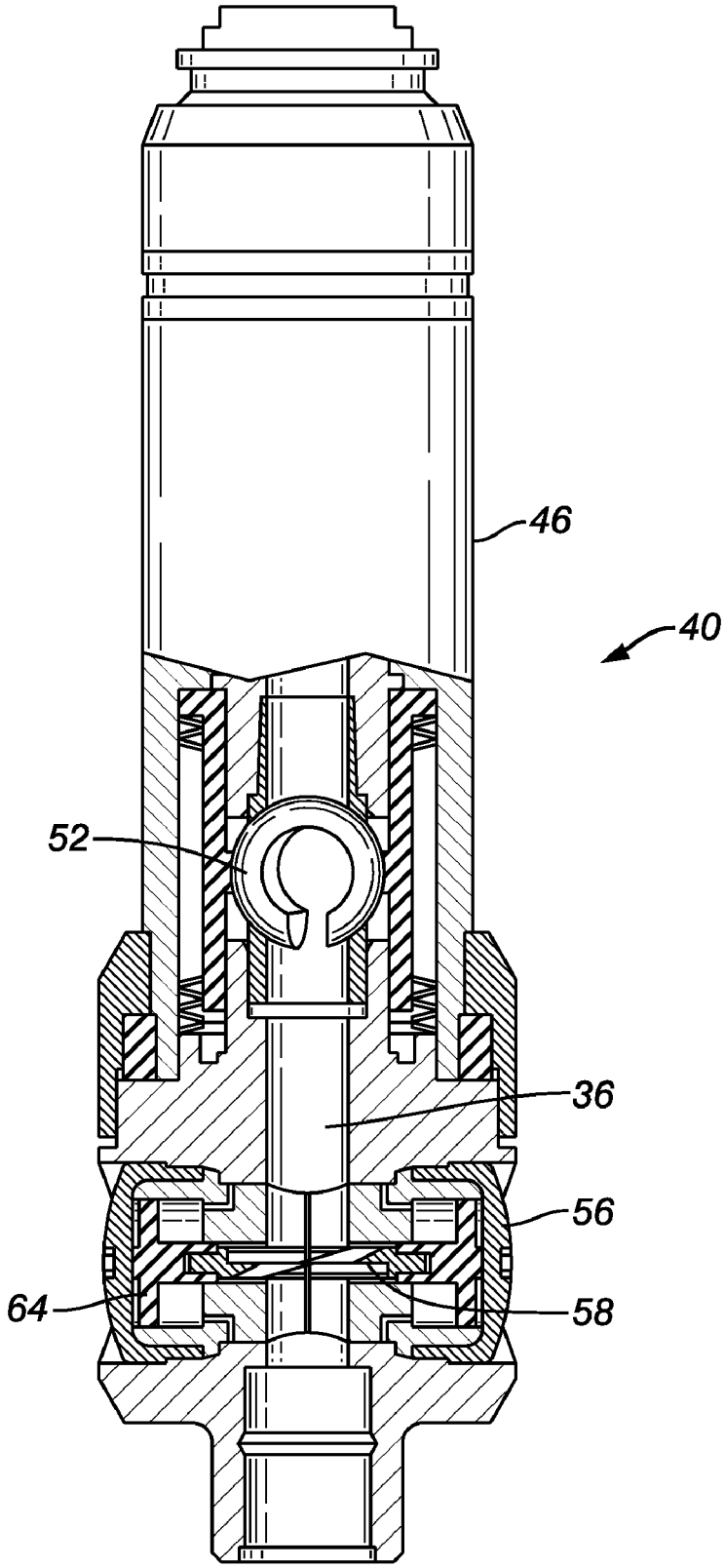
FIG. 4 illustrates an embodiment of the cutting module housed within a subsea tree and with its cutting blades activated.

FIG. 4 illustrates an embodiment of the cutting module 56 with the cutting blades 58 activated. The cutting module 56 is housed within a subsea tree 40 that includes a valve assembly 46 having a ball valve 52. The cutting module 56 is located below the ball valve 52.

Upon activation by applying pressure to the piston 64, the cutting blades 58 act to sever any coiled tubing located within the cutting module 56. After the coiled tubing has been severed and removed from the subsea tree 40, the ball valve 52 is closed to shut-in the well.

The blades 58 utilized by the cutting module 56 are designed specifically for cutting and thus provide a more efficient cut than traditional equipment such as ball valves used to cut coiled tubing. In tests conducted within Schlumberger's labs, the efficiency of a ball valve in cutting is approximately 20% versus a basic shear approximation. By contrast, the cutting blades 58 of the cutting module 56 have shown an efficiency of over 100%.

Additionally, cutting large diameter coiled tubing with ball valves can require the coiled tubing to be subjected to a large amount of tension. By contrast, the cutting module 56 of the present invention can cut larger diameter coiled tubing in the absence of tension.

The blades 58 of the cutting module 56 are designed to prevent the collapse of the coiled tubing being cut. As a result, the cut coiled tubing is much easier to fish following the severing process. While any number of blade geometries can be used to advantage by the present invention, for purpose of illustration, two example geometries are shown in FIGS. 5 and 6.

Figure 5:
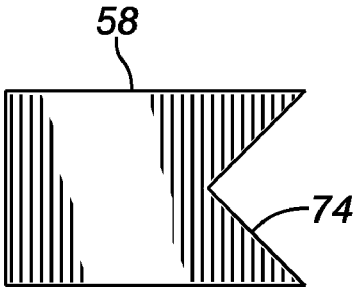
FIG. 5 provides a top view of the V-shaped geometry of one embodiment of the cutting blades.
Figure 6:
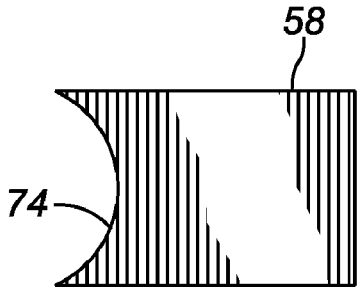
FIG. 6 provides a top view of the curved radii geometry of one embodiment of the cutting blades.

In the top view illustration of FIG. 5, the cutting surface 74 has a V-shaped geometry that acts to prevent the collapse of the coiled tubing being cut. Similarly, in the top view illustration of FIG. 6, the cutting surface 74 of the cutting blade 58 has a curved radii that closely matches the diameter of the coiled tubing deployed therebetween. Both geometries act to prevent the collapse of the coiled tubing to enable easier fishing operations.

As stated above, any number of blade geometries can be used to advantage to sever without collapsing the coiled tubing. In fact, most shapes, other than flat blade ends, will accomplish the same.

In other embodiments the cutting module 56 utilizes telescoping pistons. Due to the limited size in the tubing string 36 within which to hold cutting equipment, the use of telescoping pistons enables greater travel of the pistons, and thus attached blades, than that achievable with traditional pistons.

Figure 7:
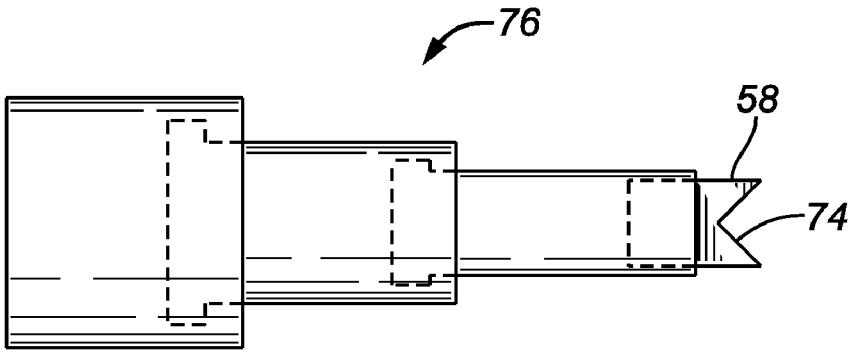
FIG. 7 provides a top view of an embodiment of the cutting module having telescoping pistons.
Figure 8:
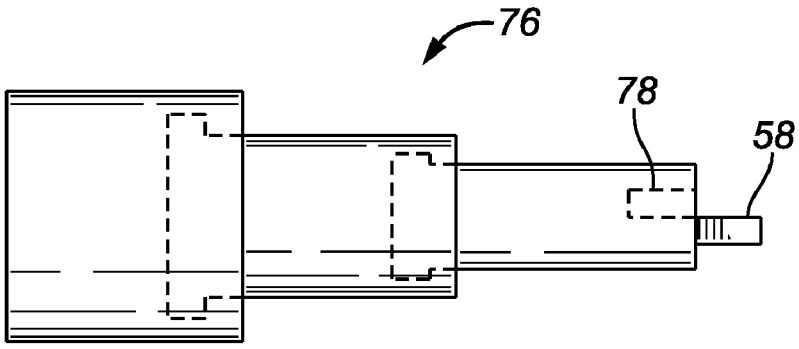
FIG. 8 provides a side view of an embodiment of the cutting module having telescoping pistons.

An embodiment of the telescoping pistons 76 is illustrated in FIGS. 7 and 8. FIG. 7 provides a top view of the telescoping piston 76 and FIG. 8 provides a side view.

The telescoping pistons 76 utilize multiple piston layers and a cutting blade 58. In the embodiment shown, the cutting surface 74 of the cutting blade 58 is a V-shaped geometry. However, it should be understood that a curved radii or other applicable geometry can be used to advantage.

The cutting module 56 utilizes two telescoping pistons 76 that lie opposite of each other. Upon pressurization, the piston layers begin their stroke and expand to a length greater than that achievable with a traditional piston. The telescoping pistons 76 expand until they overlap and the blades 58 shear any material running between them. To allow for the overlap, hollow slots 78 are provided on the face of the pistons 76 above one of the blades 58 and below the mating blade 58.

Following the cutting procedure, the supplied pressure is discontinued and the non-pressurized piston layers of the telescoping pistons 76 return to their non-extended positions as a result of the much higher bore pressure within the tubing string.

in operation, and with reference to FIG. 1, the subsea tree 40 is landed in the blowout preventer stack 22, comprising ram preventers 28 and annular preventers 30, on the tubing string 36. The flapper valve 50 and the ball valve 52 in the subsea tree 40 are open to allow fluid flow from the lower portion 42 of the tubing string 36 to the upper portion 54 of the tubing string 36. Additionally, the open valves 50, 52 allow for tools to be lowered via coiled tubing (or wireline, slickline, communication lines, etc.) through the tubing string 36 to perform intervention operations.

In the event of an emergency during an intervention operation, the cutting module 56 is activated to sever the coiled tubing. Once severed, coiled tubing remaining in the upper portion 54 of the tubing string 36 is raised until its severed end clears both the ball valve 52 and the flapper valve 50 of the valve assembly 46. At this point, the valves 50, 52 can be automatically closed to prevent fluid from flowing from the lower portion 42 of the tubing string 36 to the upper portion 54 of the tubing string 36. Once the valves 50, 52 are closed, the latch 48 is released enabling the upper portion 54 of the tubing string 36 to be disconnected from the subsea tree 40 and retrieved to the vessel 18 or raised to a level which will permit the vessel 18 to drive off if necessary.

After the emergency situation, the vessel 18 can return to the well site and the marine riser 32 can be re-connected to the blowout preventer stack 22. The safety shut-in system 38 can be deployed again and the coiled tubing that remains in the lower portion 42 of the tubing string 36 can be retrieved through various fishing operations.

It is important to note that the above embodiment is useful in both vertical and horizontal wells. Because the cutting module 56 severs the coiled tubing below the valves 50, 52, the severed portion of the coiled tubing will not interfere with the closing of the valves 50, 52.

Figure 9:
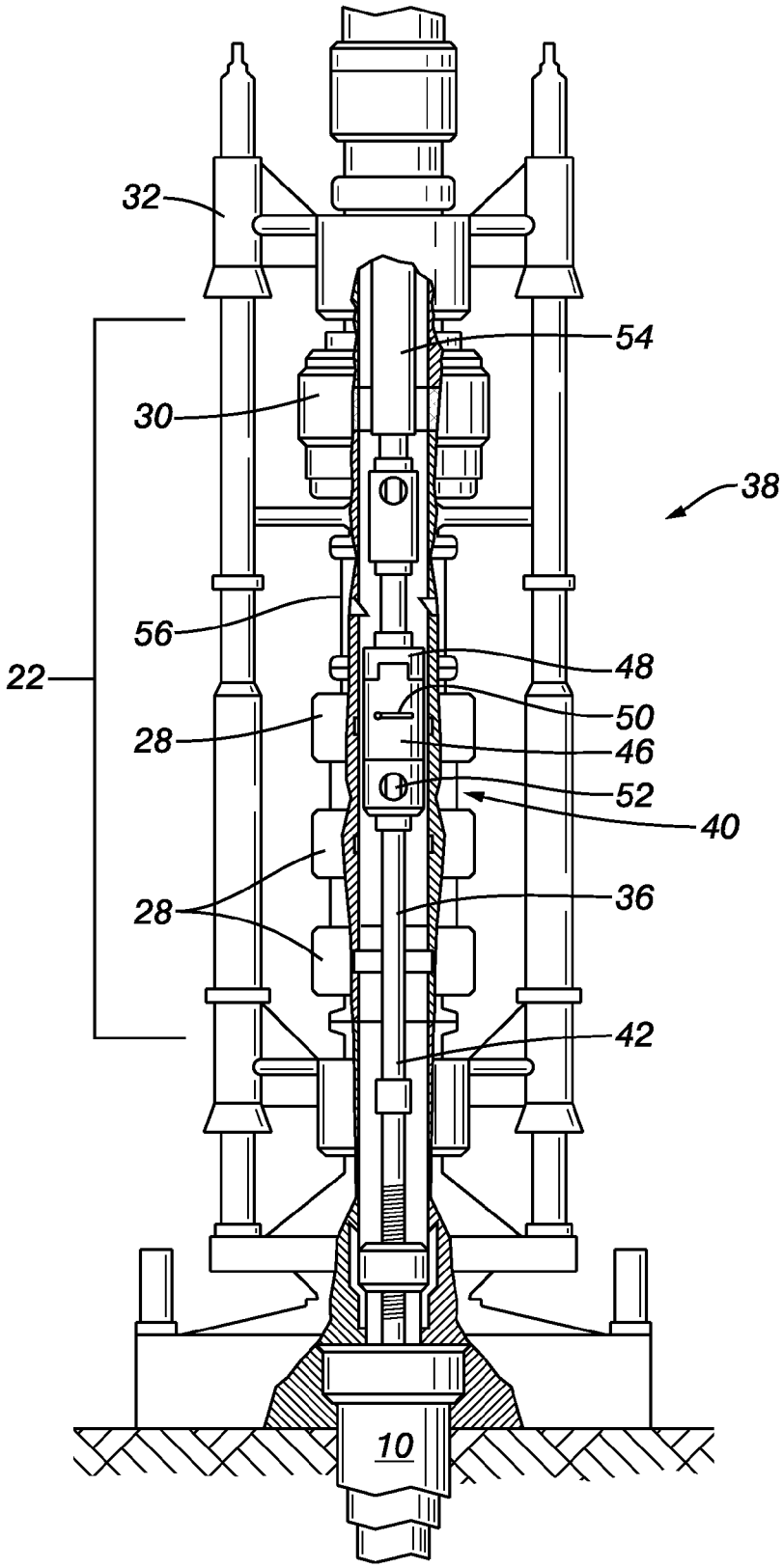
FIG. 9 illustrates an embodiment of the cutting module wherein the cutting module is located below the ball valve.

Another embodiment of the present invention is shown in FIG. 9. In this embodiment, the cutting module 56 is located above the flapper valve 50 and the ball valve 52. As such, this embodiment is useful in vertical wells.

In operation, the subsea tree 40 is landed in the blowout preventer stack 22, comprising ram preventers 28 and annular preventers 30, on the tubing string 36. The flapper valve 50 and the ball valve 52 in the subsea tree 40 are open to allow fluid flow from the lower portion 42 of the tubing string 36 to the upper portion 54 of the tubing string 36. Additionally, the open valves 50, 52 allow for tools to be lowered via coiled tubing (or wireline, slickline, communication lines, etc.) through the tubing string 36 to perform intervention operations.

In the event of an emergency during an intervention operation, the cutting module 56 is activated to sever the coiled tubing. Once severed, coiled tubing remaining in the lower portion 42 of the tubing string 36 falls within the vertical well until it has cleared both the ball valve 52 and the flapper valve 50 of the valve assembly 46. At this point, the valves 50, 52 can be automatically closed to prevent fluid from flowing from the lower portion 42 of the tubing string 36 to the upper portion 54 of the tubing string 36. Once the valves 50, 52 are closed, the latch 48 is released to enable the upper portion 54 of the tubing string 36 to be disconnected from the subsea tree 40 and retrieved to the vessel (not shown) or raised to a level which will permit the vessel to drive off if necessary.

After the emergency situation, the vessel can return to the well site and the marine riser 32 can be re-connected to the blowout preventer stack 22. The safety shut-in system 38 can be deployed again and the coiled tubing that remains in the lower portion 42 of the tubing string 36 can be retrieved through various fishing operations.

While the invention has been described with respect to a limited number of embodiments, those skilled in the art will appreciate numerous variations therefrom without departing from the spirit and scope of the invention.

What is claimed is:

1. A cutting module to sever a tubing in a well, the cutting module comprising:

a first piston comprising at least two moveable telescoping elements adapted to expand the first piston from a retracted length to an expanded length; and a first shear blade connected to the first piston to sever the tubing in response to the piston expanding from the retracted length to the expanded length, wherein the cutting module is located below a safety valve in the well.

2. The cutting module of claim 1, wherein one of said at least two moveable telescoping elements comprises a first telescoping element that telescopes inside a stationary tubular body and the other of said at least two moveable telescoping elements comprises a second telescoping element that telescopes inside the first telescoping element.

3. The cutting module of claim 1, further comprising:

another piston opposable to the first piston; and a second shear blade connected to said another piston, wherein said another piston is adapted to move in concert with the first piston to cause the first and second shear blades to sever the tubing.

4. The cutting module of claim 3, wherein the first and second shear blades are adapted to overlap.

5. The cutting module of claim 1, wherein the first piston is adapted to be activated by pressure.

6. The cutting module of claim 1, wherein the first piston further comprises a hollow slot to accommodate an overlap of the first shear blade with another shear blade.

7. The cutting module of claim 1, wherein the first shear blade has a V-shaped cutting surface.

8. The cutting module of claim 1, wherein the first shear blade has a curved radii cutting surface.

9. The cutting module of claim 8, wherein the curved radii matches the radius of the tubing to be severed.

10. The cutting module of claim 1, wherein the cutting module is located in a subsea production system.

11. The cutting module of claim 1, wherein the cutting module is located in a subsea test tree.

12. The cutting module of claim 1, wherein the safety valve comprises a ball valve.

13. A method to sever a tubing in a well, the method comprising:

moving at least three moveable telescoping elements of a first piston to cause the first piston to expand from a first retracted length to a second expanded length; and driving a first shear blade with the piston to sever the tubing.

14. The method of claim 13, wherein the act of moving comprises:

moving one of said at least three moveable telescoping elements inside a stationary tubular body and moving another of said at least three moveable telescoping elements inside said one of said at least three moveable telescoping elements.

15. The method of claim 13, further comprising:

providing another piston opposable to the first piston; and moving said another piston to drive a second shear blade to sever the tubing.

16. The method of claim 15, further comprising: overlapping the first shear blade with a second shear blade to sever the tubing.

17. A system comprising:

a blowout preventer stack adapted to seal and contain pressure in a well, the blowout preventer having a passageway through which a tubular string may extend into the well;

a subsea wellhead;

a safety shut-in system having a valve assembly adapted to control flow and adapted to allow tools to be lowered therethrough on tubing; and a cutting module located below the valve assembly and adapted to be run into the passageway and adapted to allow tools to be lowered into the passageway on tubing, the cutting module comprising:

a first piston comprising at least two moveable telescoping elements adapted to expand the first piston from a first retracted length to a second expanded length; and a first shear blade connected to the first piston to sever a tubing in the passageway in response to the piston expanding from the first retracted length to the second expanded length.

18. The system of claim 17, wherein the cutting module further comprises:

a second piston adapted to oppose the first piston and comprising at least two moveable telescoping elements.

19. The system of claim 18, further comprising:

a second shear blade connected to the second piston and adapted to overlap with the first shear blade in response to activation of the first and second pistons.

* * * * *